US006425549B1

(12) United States Patent
Bae et al.

(10) Patent No.: US 6,425,549 B1
(45) Date of Patent: Jul. 30, 2002

(54) STEEL CORD TAKE-UP SPOOL

(75) Inventors: Dal Hyang Bae; Jae Il Kwon; Jong Sik Park, all of Woolsan-shi (KR)

(73) Assignee: Hyosung Corporation, Seoul (KR)

( * ) Notice: Subject to any disclaimer, the term of this patent is extended or adjusted under 35 U.S.C. 154(b) by 0 days.

(21) Appl. No.: 09/693,971

(22) Filed: Oct. 23, 2000

(30) Foreign Application Priority Data

Oct. 28, 1999 (KR) ..... 99-47206

(51) Int. Cl.[7] ..... B65H 75/00; B65H 75/02
(52) U.S. Cl. ..... 242/580
(58) Field of Search ..... 242/402, 404, 242/404.2, 404.3; 403/203, 205, 225, 226, 291; 24/3.11, 3.12, 570, 910

(56) References Cited

U.S. PATENT DOCUMENTS 5,485,968 A * 1/1996 Fujioka ..... 242/125.2
5,549,257 A * 8/1996 Sanda et al. ..... 242/580
5,586,733 A * 12/1996 Miura et al. ..... 242/125.2
5,603,469 A * 2/1997 Stocchi ..... 242/580
5,931,408 A * 8/1999 Ishii et al. ..... 242/580

* cited by examiner

*Primary Examiner*—Donald P. Walsh
*Assistant Examiner*—Mark J. Beauchaine
(74) *Attorney, Agent, or Firm*—Sughrue Mion, PLLC

(57) ABSTRACT

A steel cord take-up spool, having a specifically designed clip and a specifically designed rib flange, is disclosed. The clip of the spool easily and simply holds the free end of a steel cord at the inside surface of the rib flange, and prevents the clamped end of the steel cord from being undesirably released from the spool due to external impact. The clip has a cord clamping part, an undesired cord release preventing part, a bent part providing elasticity for the cord clamping part, and an attaching part used for mounting the clip to the rib flange. The rib flange is provided with a hole for allowing the cord release preventing part of the clip to pass through. This rib flange also has a slit, allowing the attaching part of the clip to pass through and seating the bent part of the clip therein. The spool of this invention thus improves work efficiency while clamping the free end of the steel cord and conserves time and labor while releasing the clamped ends of steel cords from the spools during a calendering process. The spool of this invention is thus preferably used for storing steel cords, typically used as reinforcement cords for a variety of elastic products, such as steel belted tires or conveyor belts.

3 Claims, 5 Drawing Sheets

STEEL CORD TAKE-UP SPOOL

BACKGROUND OF THE INVENTION

1. Field of the Invention

The present invention relates, in general, to steel cord take-up spools for storing steel cords, typically used as reinforcement cords for a variety of elastic products, such as steel belted tires, conveyor belts, polyurethane or rubber timing belts or tubes, during a transportation or storage of such steel cords and, more particularly, to a steel cord take-up spool provided with a clip, consisting of a cord clamping part, an undesired cord release preventing part, a bent part, and a clip attaching part and being attached to a rib flange of the spool having a hole and a slit, the clip elastically holding the free end of the steel cord at the inside surface of the rib flange after the steel cord is completely wound around the rib of the spool, thus allowing a user to easily and simply hold or release the free end of the steel cord to or from the rib flange.

2. Description of the Prior Art

In order to produce a steel cord used as a reinforcement cord in the prior art, a plurality of filaments, having a diameter of 0.1 mm–0.4 mm and made of carbon steel having a carbon content of 0.6 wt %–0.95 wt %, are primarily plated with brass to have a brass layer having a thickness of 0.1 m–0.4 m. The brass-plated carbon steel filaments are, thereafter, twisted together by a twisting machine to form a resulting steel cord having a desired strand structure, such as 1×3, 1×4, 2+2, 2+7, 3+6, or 3+9+15 strand structure. Such conventional steel cords are superior in strength, modulus, heat resistance, and fatigue resistance in comparison with conventional organic and inorganic fibers, and so the steel cords have been preferably used as reinforcement cords for a variety of elastic products, such as steel belted tires or conveyor belts.

The conventional process of producing such steel cords is finished at a filament twisting process. In such a filament twisting process, two or more metal filaments from a drawing process are twisted together by a twisting machine to form a resulting steel cord having a desired strand structure. The steel cord is continuously discharged from the cord outlet unit of the twisting machine and is wound around a take-up spool. When a desired length of steel cord is completely wound around one take-up spool, it is necessary to clamp the free end of the cord to the spool.

FIG. 1 is a perspective view of a steel cord take-up spool having a conventional cord clamping structure. In order to clamp the free end of a steel cord on the spool having the conventional cord clamping structure after the steel cord is completely wound around the rib of the spool, the free end "So" of the steel cord "S" passes through a small-diameter hole 12, formed on the rib flange 11 of the spool, prior to holding the end "So" of the cord by using a clip 13 fixedly mounted to the outside surface of the rib flange 11. However, the conventional cord clamping structure of the steel cord take-up spool is problematic in that the passing of the free end "So" of the steel cord through the hole 12 is difficult and consumes excessive time and labor. Furthermore, when the free end "So" of the steel cord becomes untwisted, it is almost impossible to pass the free end "So" through the hole 12. Therefore, the conventional cord clamping structure forces the free end "So" of the steel cord to be additionally treated through a taping or welding process to prevent the free end "So" from becoming untwisted. The conventional cord clamping structure of the spool thus reduces productivity while clamping the free end of a steel cord to the spool.

In a conventional process of producing steel belted tires using such steel cords, the steel cords have to be coated with rubber through a calendering process. In such a calendering process, it is typical to feed five hundred or more steel cords from the same number of spools to a calender at the same time. It is thus necessary to release the clamped ends "So" of the five hundred or more steel cords "S" from the cord clamping structures of the spools one by one. This regrettably consumes excessive time and labor, and so it is necessary to propose a steel cord take-up spool having a structurally improved cord clamping structure capable of reducing the consumption of time and labor while clamping or releasing the end of a steel cord wound around the spool.

SUMMARY OF THE INVENTION

Accordingly, the present invention has been made keeping in mind the above problems occurring in the prior art, and an object of the present invention is to provide a steel cord take-up spool, which is designed to improve work efficiency while clamping the free end of a steel cord and to conserve time and labor while releasing the clamped end of the steel cord during a calendering process.

Another object of the present invention is to provide a steel cord take-up spool, which is designed to prevent the clamped end of a steel cord from being undesirably released during a transportation or storage of the spools having the steel cords.

In order to accomplish the above objects, the present invention provides a steel cord take-up spool comprising a clip, designed to hold the free end of a steel cord, wound around the rib of the spool, at the inside surface of the rib flange, the clip also having a means for preventing the clamped end of the steel cord from being undesirably released from the rib flange due to external impact.

In a preferred embodiment of the present invention, the steel cord take-up spool, comprising a clip consisting of a cord clamping part used for clamping the free end of a steel cord wound around the spool, an undesired cord release preventing part extending from the cord clamping part and used for preventing the end of the steel cord from being undesirably released from the cord clamping part, a bent part extending from the cord release preventing part and having a crank-shaped cross-section suitable for providing elasticity for the cord clamping part, and an attaching part extending from the bent part and used for attaching the clip to a rib flange of the spool; and the rib flange provided with a hole for allowing the cord release preventing part of the clip to pass through, the rib flange also having a slit designed to allow the attaching part of the clip to pass through and to seat the bent part of the clip therein, whereby the attaching part of the clip passes through the slit of the rib flange in a direction from the inside to the outside surface of the flange prior to being mounted to the outside surface of the flange, the cord clamping part of the clip elastically clamps the free end of the steel cord using elasticity provided by the bent part, and the cord release preventing part is inserted into the hole of the flange in a direction from the inside to the outside surface of the flange and prevents the end of the steel cord from being undesirably released from the cord clamping part of the clip.

BRIEF DESCRIPTION OF THE DRAWINGS

The above and other objects, features and other advantages of the present invention will be more clearly under stood from the following detailed description taken in conjunction with the accompanying drawings, in which:

FIG. 2(*b*) is a view taken along lines 2(*b*)—2(*b*) of a clip included in a steel cord take-up spool in accordance with the preferred embodiment of the present invention;

FIG. 2(*c*) is a plan view of a rib flange of the steel cord take-up spool of this invention;

FIG. 2(*d*) is a view taken along lines 2(*d*)—2(*d*) of a rib flange of the steel cord take-up spool of this invention;

FIG. 3(*b*) is an enlarged partial view showing the clip of this invention attached to the rib flange of the spool; and FIG. 3(*c*) is a view, showing the clip holding the free end of a steel cord wound around the spool of this invention; and FIG. 3(*d*) is an enlarged partial view, showing the clip holding the free end of a steel cord wound around the spool of this invention.

DETAILED DESCRIPTION OF THE INVENTION

Figure 1:
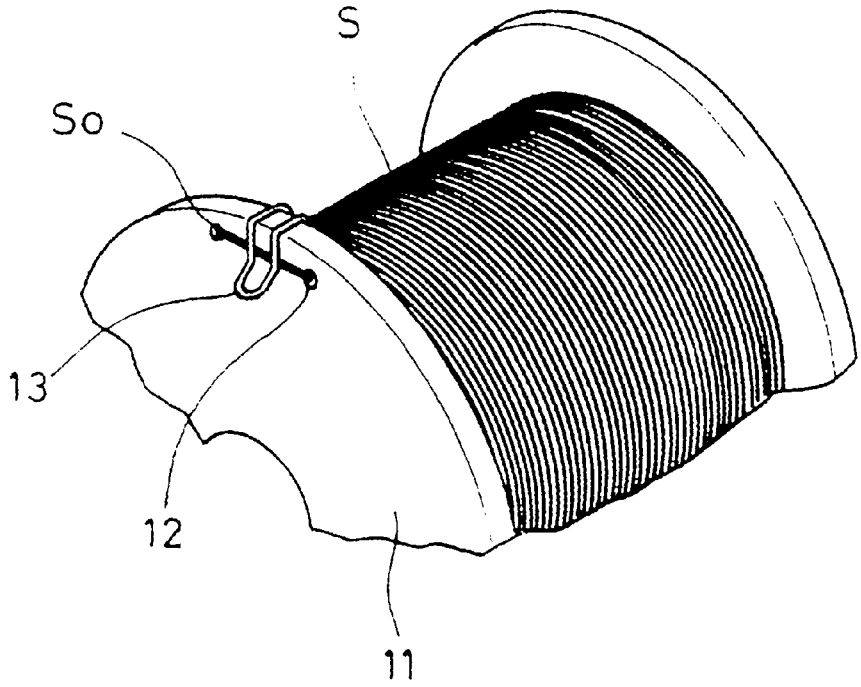
FIG. 1 (PRIOR ART)
FIG. 1 is a perspective view of a steel cord take-up spool having a conventional cord clamping structure.
Figure 2A:
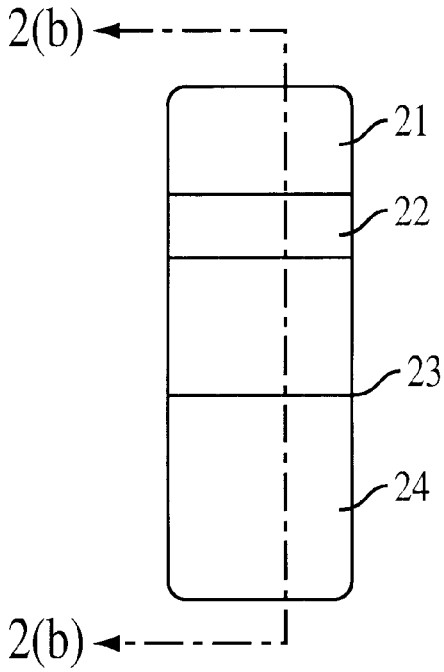
FIG. 2(*a*) is a plan view of a clip included in a steel cord take-up spool in accordance with the preferred embodiment of the present invention.
Figure 2B:
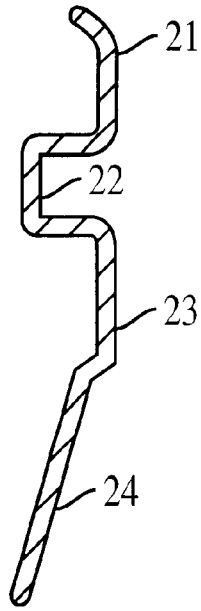
Figure 2C:
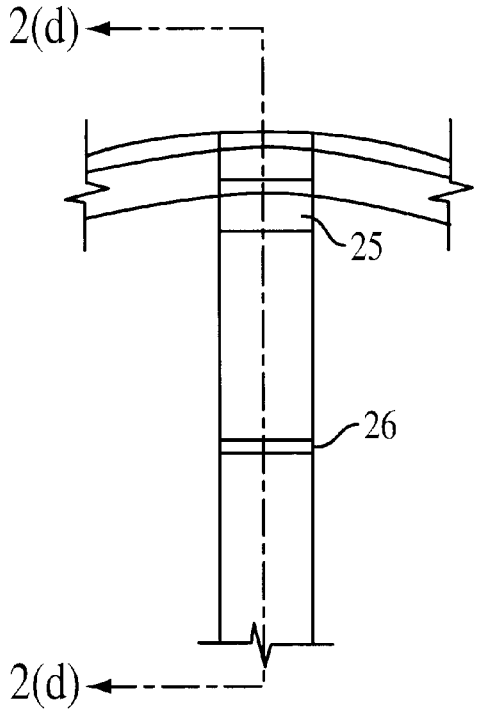
Figure 2D:
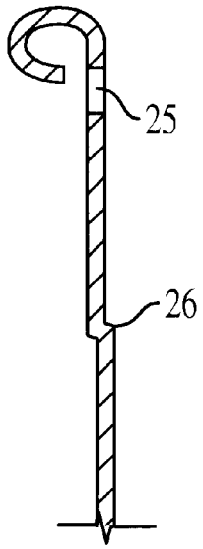

FIGS. 2(*a*) and 2(*b*) are plan and sectional views of a clip included in a steel cord take-up spool in accordance with the preferred embodiment of the present invention. FIGS. 2(*c*) and 2(*d*) are plan and sectional views of a rib flange of the steel cord take-up spool of this invention. As shown in the drawings, the clip of the spool comprises a cord clamping part 21, an undesired cord release preventing part 22 integrally extending from the cord clamping part 21, a bent part 23 integrally extending from the cord release preventing part 22 and having a crank-shaped cross-section, and a clip attaching part 24 integrally extending from the bent part 23. On the other hand, the rib flange of the spool has a hole 25 and a slit 26.

Figure 3B:
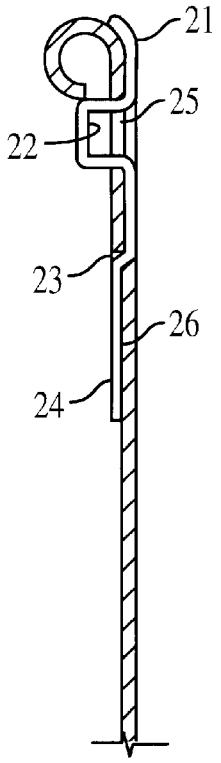
FIG. 3(*a*) is a view, showing the clip of this invention attached to the rib flange of the spool.
Figure 3A:
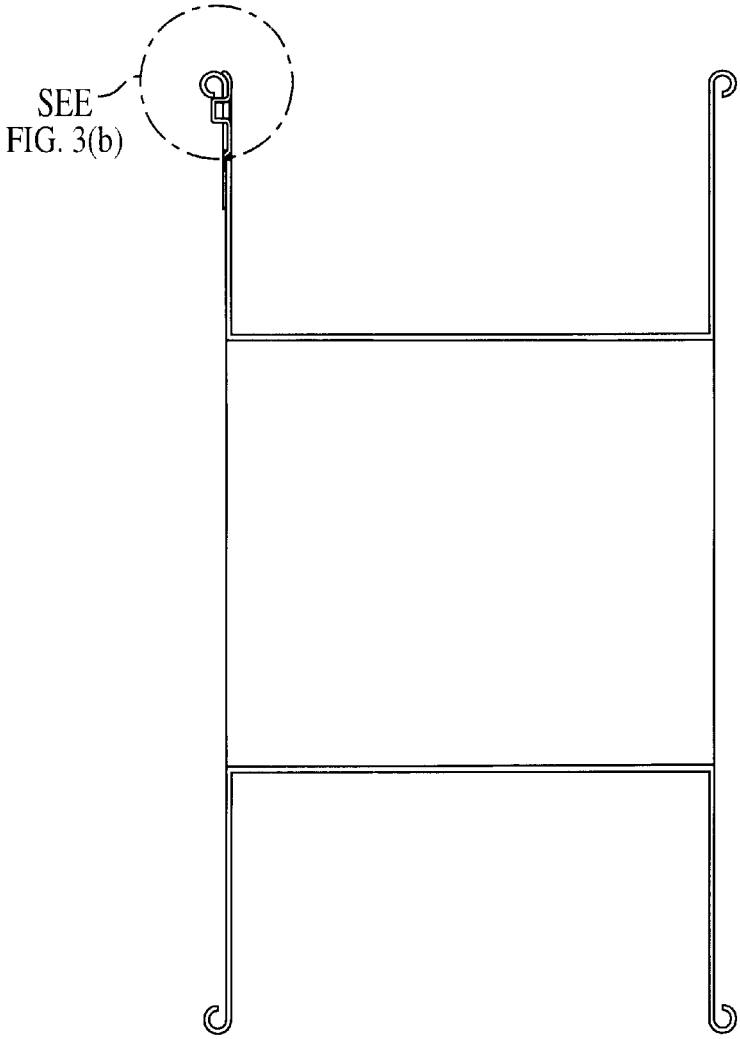
Figure 3D:
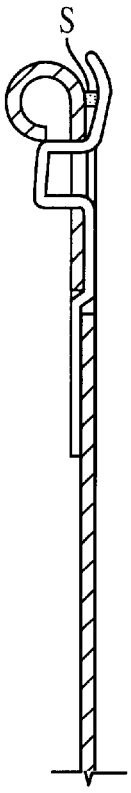
Figure 3C:
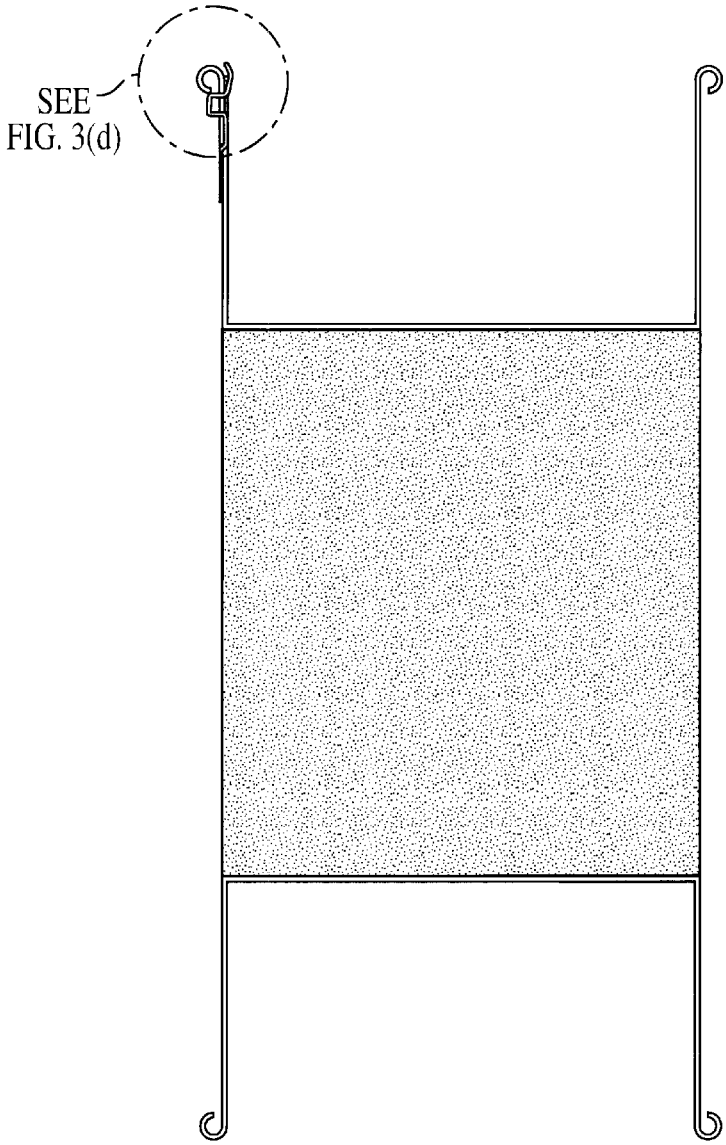

FIGS. 3(*a*) and 3(*b*) are views showing the clip of this invention attached to the rib flange of the spool. FIG. 3(*c*) and 3(*d*) are views, showing the clip holding the free end of a steel cord wound around the spool of this invention. As shown in the drawings, the cord clamping part 21 of the clip is inserted into the slit 26 of the rib flange in a direction from the inside to the outside surface of the rib flange prior to being fixed to the outside surface of the rib flange through an appropriate process, such as a welding process. In such a case, the bent part 23 of the clip is positioned at the slit of the rib flange. Elasticity of the clip in a direction toward the outside surface of the flange is changed in accordance with the bending angle of the bent part 23, and so it is possible to adjust the cord clamping force of the cord clamping part 21 by controlling the bending angle of the bent part 23. The cord clamping part 21 of the clip elastically grasps the free end "So" of the steel cord at the inside surface of the rib flange. On the other hand, the undesired cord release preventing part 22 of the clip is inserted into the hole 25 of the rib flange in a direction from the inside to the outside surface of the rib flange. The undesired cord release preventing part 22 prevents the clamped end "So" of the steel cord from being released from the cord clamping part 21 due to external impact acting in a direction toward the center of the flange. The cord release preventing part 22 projects on the outside surface of the rib flange. Due to such a projecting structure of the cord release preventing part 22, the clip can be elastically deformed in a direction from the outside to the inside surface of the rib flange to form a desired gap between the cord clamping part 21 of the clip and the inside surface of the rib flange by simply pressing the cord release preventing part 22 at the outside surface of the rib flange, when it is desired to form such a gap for allowing the cord to pass through the gap during a cord clamping process.

In the present invention, the cord release preventing part 22 of the clip may have a desired cross-section, such as a U-shaped cross-section, a trapezoidal cross-section, or a semicircular cross-section, without affecting the functioning of this invention if the part 22 can effectively prevent the clamped end of the steel cord from being released from the cord clamping part due to external impact acting in the direction toward the center of the flange.

In addition, the end of the cord clamping part 21 is bent along the outside edge of the rib flange in a direction toward the outside surface of the flange. Therefore, it is possible to prevent an undesired release of the clamped end of the steel cord due to external impact acting in a direction toward the outside edge of the flange.

As described above, the present invention provides a steel cord take-up spool, including a specifically designed clip and a specifically designed rib flange. It is thus possible to easily and simply hold the free end of a steel cord, wound around the rib of the spool, at the inside surface of the rib flange, and to prevent the clamped end of the steel cord from being undesirably released from the spool due to external impact.

Due to both the clip and the rib flange of the spool according to this invention, it is possible to clamp the free end of a steel cord to a desired portion of the spool without passing the free end of the steel cord through a small-diameter hole different from the conventional spool. The steel cord take-up spool of this invention thus improves work efficiency while clamping the free end of the steel cord and conserves time and labor while releasing the clamped ends of steel cords from spools during a calendering process. In addition, the clip of this invention has a bent part and is mounted to the outside surface of the rib flange at its attaching part, thus more effectively and more firmly clamping the free end of the steel cord at the inside surface of the flange. The clip also has an undesired cord release preventing part, and so it almost completely prevents the clamped end of the steel cord from being undesirably released from the cord clamping part of the clip regardless of external impact. Therefore, the spool of this invention is preferably used for storing steel cords, typically used as reinforcement cords for a variety of elastic products, such as steel belted tires, conveyor belts, polyurethane or rubber timing belts or tubes, during a transportation or storage of such steel cords.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A steel cord take-up spool, comprising:

a clip consisting of a cord clamping part used for clamping a free end of a steel cord wound around the spool, an undesired cord release preventing part extending from said cord clamping part and used for preventing the end of the steel cord from being undesirably released from the cord clamping part, a bent part extending from said cord release preventing part and having a crank-shaped cross-section suitable for providing elasticity for the cord clamping part, and an attaching part extending from said bent part and used for attaching the clip to a rib flange of the spool; and the rib flange provided with a hole for allowing said cord release preventing part of the clip to pass through, said rib flange also having a slit designed to allow the attaching part of the clip to pass through and to seat the bent part of the clip therein, whereby the attaching part of the clip passes through the slit of said rib flange in a direction from the inside to the outside surface of the flange prior to being mounted to the outside surface of said flange, said cord clamping part of the clip elastically clamps the free end of said steel cord using elasticity provided by the bent part, and said cord release preventing part is inserted into said hole of the flange in a direction from the inside to the outside surface of the flange and prevents the end of said steel cord from being undesirably released from the cord clamping part of the clip.

2. The steel cord take-up spool according to claim 1, wherein said cord release preventing part of the clip has a cross-section selected from the group consisting of a U-shaped cross-section, a trapezoidal cross-section, and a semicircular cross-section, and prevents the end of the steel cord from being released from the cord clamping part due to external impact.

3. The steel cord take-up spool according to claim 1, wherein said cord clamping part is bent at its end along an outside edge of said rib flange in a direction toward the outside surface of the rib flange, and prevents an undesired release of the end of the steel cord therefrom due to external impact.

* * * * *